United States Patent [19]

Petteys

[11] Patent Number: 4,981,273

[45] Date of Patent: Jan. 1, 1991

[54] AIR BAFFLE FOR STUNT KITE AND STUNT KITE

[76] Inventor: Charles Q. S. Petteys, 8231 Ravenna Ave. NE., Seattle, Wash. 98115

[21] Appl. No.: 349,447

[22] Filed: May 9, 1989

[51] Int. Cl.[5] ..... B64C 31/06

[52] U.S. Cl. ..... 244/153 R; 244/155 A

[58] Field of Search ..... 244/153 R, 154, 900, 244/901, 902, 155 A; D21/88

[56] References Cited

U.S. PATENT DOCUMENTS

| | | | |
|---|---|---|---|
| D. 274,827 | 7/1984 | Belloff | D21/88 |
| 1,016,180 | 1/1912 | Seydel | 244/153 R |
| 1,400,745 | 12/1921 | Eddy | 244/154 |
| 1,824,324 | 9/1931 | Bradford | 244/153 R |
| 2,203,150 | 6/1940 | Irvin | 244/153 R |
| 2,699,307 | 1/1955 | Corbin | 244/153 R |
| 2,971,488 | 2/1961 | Morissette | 114/103 |
| 3,053,219 | 9/1962 | Coon | 114/103 |
| 3,174,453 | 3/1965 | Lemoigne | 114/103 |
| 3,347,500 | 10/1967 | Hartig | 244/154 |
| 3,776,170 | 12/1973 | Slemmons | 114/103 |
| 3,796,399 | 3/1974 | Wechsler | 244/153 R |
| 3,860,204 | 1/1975 | Checkley | 244/153 R |
| 3,994,454 | 11/1976 | Worsham | 244/153 R |
| 4,099,690 | 7/1978 | Mendelsohn et al. | 244/153 R |
| 4,116,406 | 9/1978 | Hamilton | 244/901 |
| 4,191,349 | 3/1980 | Pravaz | 244/145 |
| 4,209,148 | 6/1980 | Lemoigne | 244/901 |
| 4,286,762 | 9/1981 | Prouty | 244/153 R |
| 4,402,277 | 9/1983 | Wainwright | 114/103 |
| 4,736,914 | 4/1988 | Tabor | 244/153 R |
| 4,846,424 | 7/1989 | Prouty | 244/153 R |

OTHER PUBLICATIONS

Windsurf Magazine, "Beyond the Ultimate Barrier–Laminar Boundary Control" by Lee M. Seiler, pp. 68–69, Apr. 1988.

American Kite Magazine, p. 58 (advertisement), Summer 1988.

Into the Wind Catalog, pp. 1–46, 1988.

REI Co-op Catalog, p. 28, 1988.

*Primary Examiner*—Charles T. Jordan

*Assistant Examiner*—Michael Carone

*Attorney, Agent, or Firm*—Larry A. Jackson

[57] ABSTRACT

An air baffle for a stunt kite affording enhanced kite control in gusty winds in which a flexible material is disposed transversely to the keel rod and adjacent to the trailing edge of the kite. Cooperating with the air baffle to provide structural and functional kite performance enhancements are the additional features of: a sail of flexible material; a keel rod; a leading edge rod substantially perpendicular to the keel rod and connected to the keel rod; a pair of wing rods connected to the ends of the leading edge rod; and a pair of cross rods disposed transversely to the keel rod.

36 Claims, 3 Drawing Sheets

AIR BAFFLE FOR STUNT KITE AND STUNT KITE

BACKGROUND OF THE INVENTION

The present invention relates to an air baffle for use on a stunt kite, and to a stunt kite. Stunt kites are extremely maneuverable, light weight kites controlled by two or more strings which are able to perform numerous high-speed aerobatic maneuvers. Many stunt kites are presently available for both recreational users and competition stunt kite enthusiasts.

One of the major problems associated with stunt kite flying is loss of control due to intermittent wind of variable force, or wind gusts. With conventional rigid frame stunt kites, wind gusts increase the force of the kite operating against the kite flyer. As the wind gust dissipates, the kite force also decreases. This means the conventional rigid frame stunt kite flyer must continually compensate for the sudden increases and decreases in pull during gusty flying conditions. Conventional stunt kites buffeted by wind gusts may also "jump" uncontrollably from location to location during flight. The air baffle of the present invention, on the other hand, is able to control wind gusts through "boundary layer recharging" so that a stunt kite equipped with this air baffle does not "jump" randomly or pull unevenly during wind gusts, but instead accelerates smoothly and controllably. This acceleration results in higher kite speeds in wind gusts than commonly attainable with a baffleless stunt kite in wind gusts, which allows one more control to perform more complex and detailed aerobatic maneuvers during gusty conditions.

Stunt kite designers are constantly attempting to produce kites which become airborne easily and which fly in winds of relatively low speeds, such as 4 to 10 miles per hour. One method used by stunt kite designers is to employ light but expensive kite materials. The air baffles of the present invention allow a kite made of relatively inexpensive materials to take-off extremely easily (without the need of a second person) and to fly in light winds. These results are obtained because the air baffle functions as a second wing which increases the total wing area and the leading edge area of the stunt kite. All of the above mentioned advantages over the prior art are amplified when the air baffle of the present invention is divided into a series of air channels.

Air baffles are known in the kite field but have not previously been specifically employed in high performance stunt kites to obtain the above described advantages. Specifically, air baffles are known in box kites, delta kite-box kite hybrids, and other kites not used for complex aerobatic maneuvers. While air baffles are known in flexifoil type stunt kites, the rear portion of these baffles are attached to the kite sail to form a pocket which is necessary to provide the flexifoil with its rigid aerodynamic shape. Thus, the air baffle of the flexifoil cannot employ "boundary layer recharging" to control wind gusts. Furthermore, the rear of the baffle of the present invention is not secured to the kite sail to inflate the present kite in order to provide an aerodynamic shape. A combination of rigid rods provides the aerodynamic shape of the present kite.

SUMMARY OF THE INVENTION

An air baffle for a stunt kite is described that prevents kite buffeting and "jumping" and provides greater control and higher maneuvering speeds in gusty winds. The air baffle is comprised of a flexible material and is disposed transversely of the trailing edge of the sail of the kite. The air baffle is aligned substantially parallel to the kite sail. A preferred feature of the air baffle includes connection of the air baffle to a cross rod of the kite to form a rigid leading edge on the air baffle. Another preferred feature is the arrangement of perpendicular partitions connecting the air baffle to the kite sail to form air channels which more evenly distribute the baffle air flow.

The disclosed stunt kite also has, in addition to the above described air baffle: a sail of flexible material; a keel rod; a leading edge rod substantially perpendicular to the keel rod and connected to the keel rod; a pair of wing rods connected to the ends of the leading edge rod; and a pair of cross rods substantially perpendicular to the keel rod and disposed transversely to the kite sail.

DESCRIPTION OF THE PREFERRED EMBODIMENT

Figure 1:
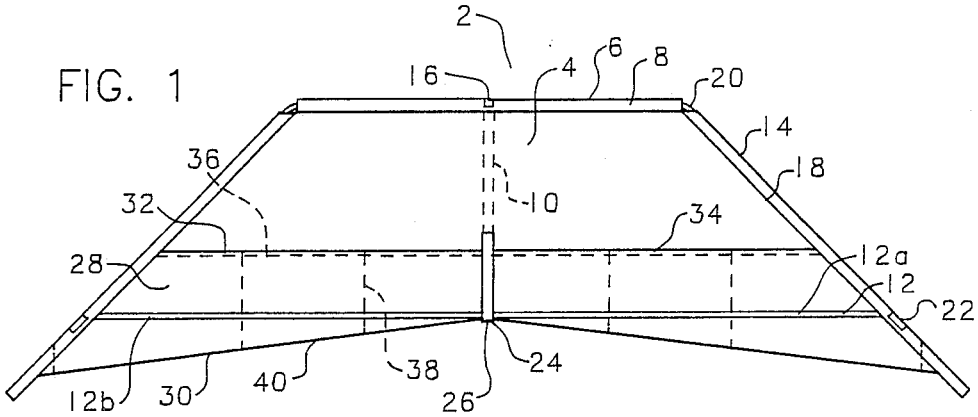
FIG. 1 is a bottom view of the stunt kite having air baffles in accordance with the present invention.
Figure 2:
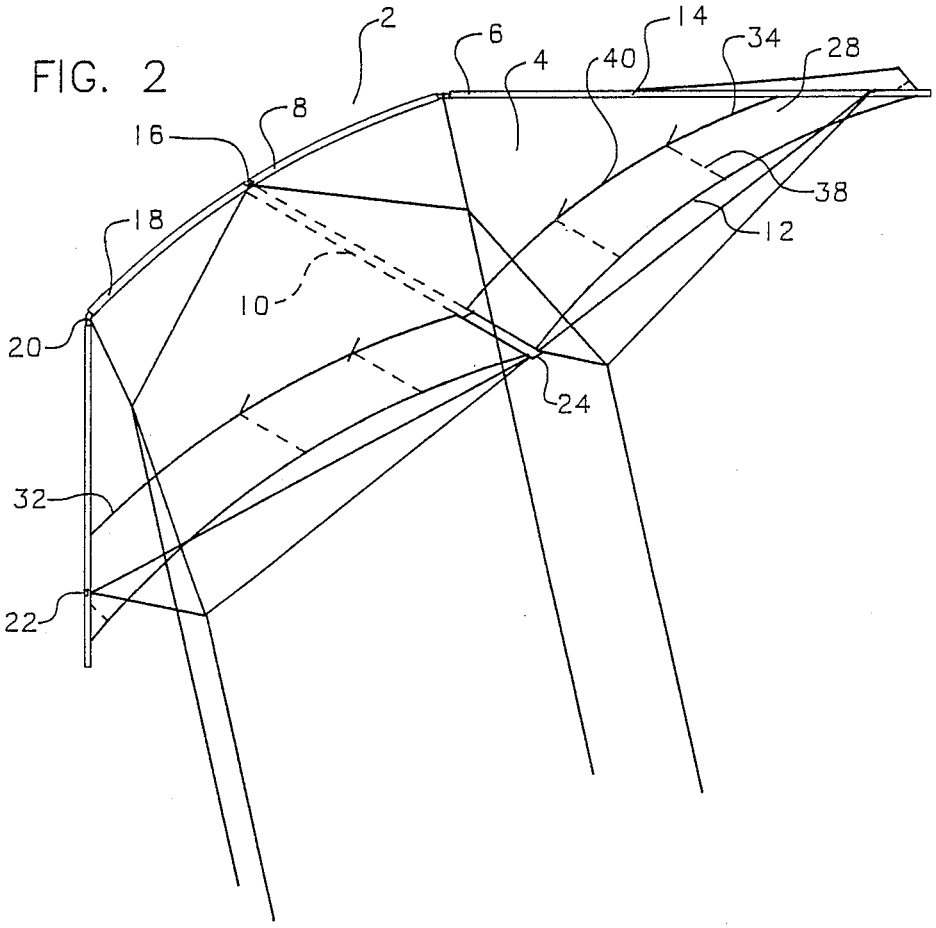
FIG. 2 is a perspective view of the stunt kite having air baffles while in flight.

Referring to FIGS. 1 and 2, a preferred embodiment of a stunt kite is shown having the advantages of aerobatic maneuverability, ease of take-off, and ability to fly in light winds. Stunt kite 2 includes a sail 4 preferably made of a synthetic polyester fabric, such as Nylon® Ripstop. Frame 6 supports sail 4 and is of a generally trapezoidal shape. Frame 6 is comprised of leading edge rod 8, keel rod 10, lower cross rod 12 and wing rods 14. The above mentioned hollow rods are preferably made of fiber reinforced plastic, such as Fiberglas® but may be composed of any resilient material with a low weight to strength ratio such as graphite, aluminum or wood.

Leading edge rod 8 is preferably 0.317 inches in diameter but may have a diameter between 0.275 inches and 0.400 inches. Leading edge rod 8 is 82.55 cm in length in the preferred embodiment, but may range between 77.55 and 87.55 cm. Keel rod 10, lower cross rod 12 and wing rod 14 are preferably 0.261 inches in diameter, but may range in diameter from 0.200 to 0.350 of an inch. Keel rod 10 is preferably 41.25 cm long but may range between 38.75 and 43.75 cm. Lower cross rod 12 is 165.10 cm in length in the preferred embodiment, but may range between 155.10 and 175.10 cm.

In the preferred embodiment, lower cross rod 12 is divided into two sections, **12*a* and 12*b*, each of which is 82.55 cm in length. Preferably, lower cross rod 12 is 41.25 cm from leading edge rod 8, but lower cross rod 12 may be between 36.25 and 46.25 cm from leading edge rod 8. Wing rods 14** are preferably 82.55 cm long but may range between 77.55 and 87.55 cm. The above dimensions and ranges of dimensions pertain to a kite with a 2 meter wing span, and will vary proportionally if the wing span of the kite varies.

Keel rod 10 is connected to leading edge rod 8 by front connector 16 and is substantially perpendicular to leading edge rod 8. Front connector 16 and the other connectors disclosed herein are preferably vinyl tubing having holes for rod connection therein, and are well known in the art.

Leading edge rod 8, keel rod 10, and wing rods 14 are enclosed in seams 18 of sail 4. Each wing rod 14 is connected to an end of leading edge rod 8 via an upper wing connector 20.

As stated above, lower cross rod 12 is preferably divided into two sections, 12*a* and 12*b*. The two sections of L. lower cross rod, 12*a* and 12*b*, are preferably parallel to leading edge rod 8 and each one is connected to one of wing rods 14 by one of two lower wing connectors 22. The two sections of lower cross rod, 12*a* and 12*b*, are further secured by connection to keel rod 10 via rear connector 24. Rear connector 24 is covered by a sail flap 26 preferably comprised of Dacron ® and Velcro ® which provides a secure linkage of sail 4 to frame 6.

Frame 6 comprised of the above described rods facilitates flight of stunt kite 2 by providing a rigid framework along the outer boundaries and central portion of sail 4 while allowing the remaining portions of sail 4 to billow in response to air flow. Frame 6 and sail 4 thus combine to form the aerodynamic wing structure having a rigid attack edge necessary for flight of stunt kite 2.

Figure 3:
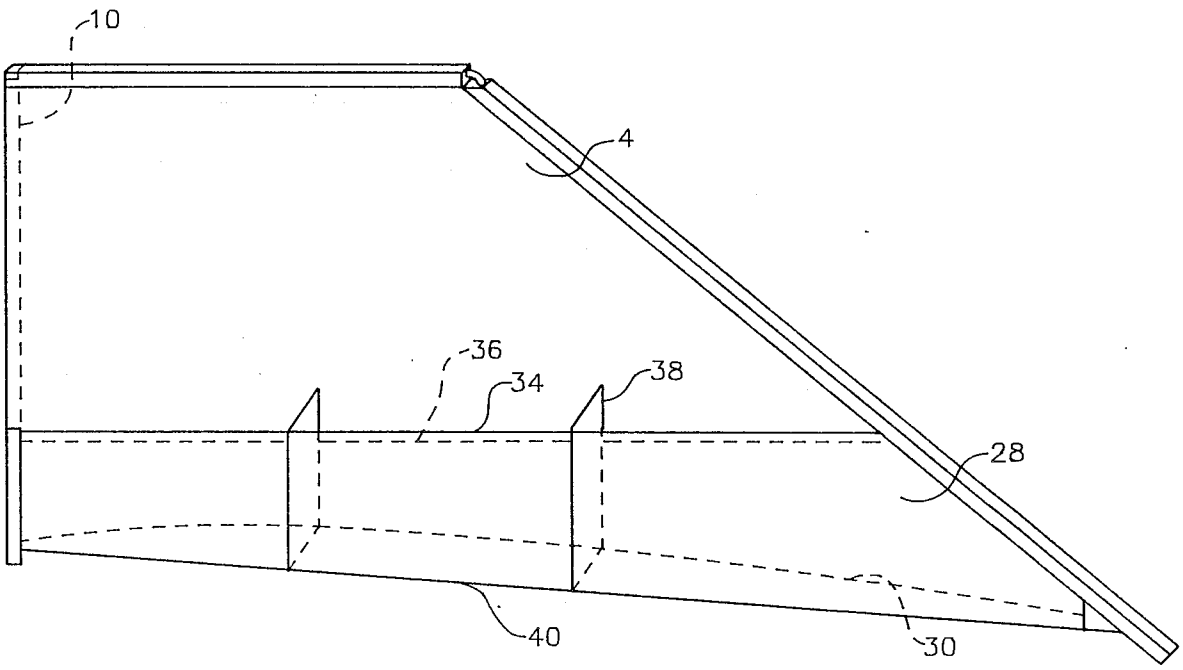
FIG. 3 is a close-up isometric view of the air baffle in accordance with the present invention.

As shown in FIGS. 1, 2 and 3, air baffle 28, comprised of a flexible material similar to that of sail 4, is disposed transversely of the keel rod 10 and adjacent to the trailing edge 30 of sail 4. Air baffle 28 is situated substantially parallel to sail 4 and, in the preferred embodiment, covers almost the entire width of sail 4 and is approximately 10 cm in height. However, the height and width of air baffle 28 can be varied in order to obtain the maximum aerodynamic benefit for the particular size and shape of stunt kite used. Note specifically that the air baffle 28 may be used with almost any type of high performance stunt kite currently commercially available, and this disclosure is not intended to limit the use of air baffle 28 to the particular stunt kite design embodied herein.

Air baffle 28 is preferably secured near each wing rod 14 and near both sides of keel rod 10 to form two separate baffles.

Air baffle 28 houses upper cross rods 32 and 34 in seam 36. Upper cross rods are pultruded fiber reinforced plastic rods, such as Fiberglas ® preferably 3/32 of an inch in diameter and 73.0 cm in length. Upper cross rods 32 and 34 may vary in diameter between 1/32 and 5/32 of an inch and between 68.0 and 78.0 cm in length for a stunt kite with a 2 meter wing span. Futhermore, upper cross rods 32 and 34 are 31.25 cm from leading edge rod 8 but upper cross rods 32 and 34 may be between 26.25 and 36.25 cm below leading edge rod 8. Alternately, upper cross rods 32 and 34 may be formed from a single rod between 136.00 and 156.00 cm in length.

Still referring to FIGS. 1, 2 and 3, partitions 38 may be comprised of a flexible material similar to that of sail 4, or of an elastomeric material. Partitions 38 are segments preferably perpendicular to both air baffle 28 and sail 4 and which connect the two to form air channels 40. Two partitions 38 are located on each half of sail 4, thus producing three air channels 40 on each sail half in the preferred embodiment. These six air channels 40 are preferably each 25 cm in width. However, the number and width of the air channels 40 can vary as needed based on the size and type of stunt kite employed.

Figure 4:
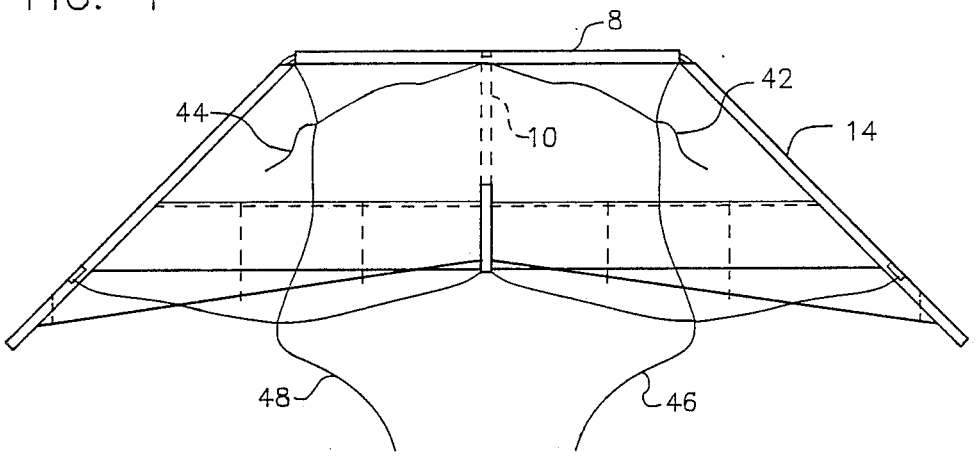
FIG. 4 is a bottom view of the stunt kite having air baffles showing a 4 line control configuration in accordance with the present invention.

The stunt kite having baffles of the present invention is preferably controlled with a four control line system as shown in FIG. 4, in which each of the upper control lines 42 and 44 are connected to leader strings which, in turn, are connected to the kite frame at or near the juncture of leading edge rod 8 with a wing rod 14 and at or near the juncture of leading edge rod 8 and keel rod 10. Each of the lower control lines 46 and 48 are connected to leader strings which, in turn, are connected to the kite frame at the bottom ends of keel rod 10 and a wing rod 14. Finally, the leader strings of the upper control lines and lower control lines are joined by leader strings substantially parallel to keel rod 10 at the points of attachment of upper control lines 42 and 44 and lower control lines 46 and 48 with their respective leader strings.

Figure 5:
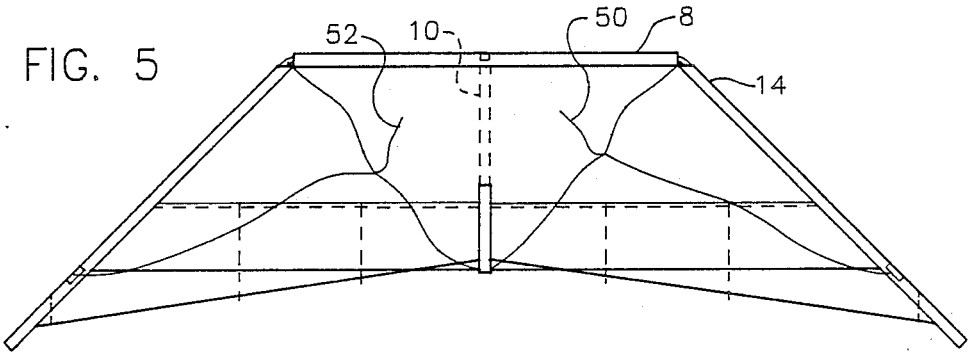
FIG. 5 is a bottom view of the stunt kite having air baffles having a 2 line control configuration in accordance with the present invention.

The stunt kite having baffles may also be controlled with a two control line system, as shown in FIG. 5, in which control lines 50 and 52 each connect at or near the juncture of leading edge rod 8 with a wing rod 14, at another portion of a wing rod 14, and at the bottom end of keel rod 10 via a combination of swivel snaps and leader strings well known in the art.

In operation, the stunt kite with baffles has the following advantages over conventional stunt kites: superior control during wind gusts, higher kite speeds in high winds, easier take-offs, superior ability to fly in lighter winds, and improved recovery from "over control" maneuvers.

The air baffles 28 of stunt kite 2 are responsible for the above advantages by laminar boundary control of the air flow over sail 4. This control of the laminar boundary by baffle 28 is obtained by "boundary layer recharging". The laminar boundary is a thin layer of air sandwiched between fast moving air molecules passing over the surface of stunt kite 2 and air molecules which move negligibly due to contact with the rough surface of sail 4. Under ideal conditions this slower moving boundary layer acts as a lubricant for the faster moving air flow because it is much smoother than the surface of sail 4.

However, when the wind speed increases past a certain point, and especially during wind gusts, a phenomenon called "boundary layer separation" occurs. In boundary layer separation, air molecules from the boundary layer which have piled up on the trailing edge of the sail rush into the increased low pressure zone caused by the wind gust. The result is a series of unstable standing pressure waves which are dynamic within the low pressure zone. As these standing waves move, a conventional stunt kite will pull unevenly against the flyer and may "jump" from one location to another.

Air baffle 28 avoids boundary layer separation by using "boundary layer recharging", which is a re-acceleration of the boundary layer air molecules that have lost energy through contact with the surface of sail 4. Not only does the boundary layer recharging caused by air baffle 28 avoid the buffeting or jumping experienced by a conventional stunt kite in wind gusts, but it also causes greater lift during high winds, which equates to higher stunt kite speeds.

The above listed advantages of air baffle 28 during stunt kite operation are amplified by the insertion of upper cross rods 32 and 34 in seam 36 of air baffle 28 to allow air baffle 28 to act as an extra rigid wing. This extra rigid wing especially aids in flying in light winds and in take-offs during all wind conditions.

The addition of partitions 38 to air baffle 28 produces air channels 40 which distribute the air flow over the trailing edge of sail 4 more evenly during flight to further prevent uneven pull or "jumping" during wind gusts. These air channels 40, in combination with the extra rigid wing formed by upper cross rods 32 and 34, also greatly improve recovery from "over control" which is an overcompensation caused by a kite flier steering excessively in one particular direction. Air channels 40 must be disposed substantially parallel to keel rod 10. If air channels 40 are angled, to follow an angled trailing edge of sail 4 for example, the stunt kite 2 will be very difficult to control.

The use of an elastic material for partition 39 enables the distance between baffle 28 and sail 4 to expand and contract depending on the strength of the wind gust. This variable baffle regulates the amount of air flowing between baffle 28 and sail 4, thereby alleviating excess pressure against the kite with no loss of lift or control.

While particular embodiments of the invention have been described above, changes and modifications may be made in the illustrated embodiments without departing from the spirit or form of the invention. It is therefore intended that the following claims cover all equivalent modifications and variations which fall within the scope of the invention as defined by the claims.

I claim:

1. A stunt kite comprising:

a sail;

a cross rod; and an air baffle comprising a sheet of flexible material connected to said cross rod and disposed transversely of said kite and substantially parallel to said sail to form a passageway through which air flows.

2. The stunt kite of claim 1 further comprising a trailing edge portion, said air baffle disposed adjacent to said trailing edge portion.

3. The stunt kite of claim 1 further comprising a pair of wing rods and a keel rod, said baffle connected to said sail near each of said wing rods and near each side of said keel rod.

4. The stunt kite of claim 1 further comprising a partition disposed between said air baffle and said sail, said partition forming air channels within said air baffle.

5. The stunt kite of claim 4 wherein said partition is comprised of elastomeric material.

6. The stunt kite of claim 4 comprising a plurality of said partitions forming a plurality of air channels.

7. The stunt kite of claim 4 wherein each of said air channels is about 20.00–30.00 cm in width.

8. A stunt kite comprising:

a sail of flexible material;

a keel rod;

a leading edge rod substantially perpendicular to said keel rod and connecting to an end of said keel rod;

a pair of wing rods connected to opposite ends of said leading edge rod, and positioned laterally to and on opposite sides of said keel rod and extending rearwardly from said leading edge rod;

upper and lower cross rods disposed transversely of said keel rod, at least one of said cross rods connected to said wing rods and said keel rod; and an air baffle of flexible material disposed transversely of said keel rod and connected to said upper cross rod to form a passageway through which air flows.

9. The stunt kite of claim 8 wherein said cross rods are divided into segments.

10. The stunt kit of claim 8 wherein said kite has a trailing edge portion and said air baffle is disposed adjacent to said trailing edge portion.

11. The stunt kite of claim 8 wherein said air baffle is connected to said sail near each of said wing rods and near both sides of said keel rod.

12. The stunt kite of claim 8 further comprising a partition disposed between said sail and said air baffle, said partition forming air channels within said air baffle.

13. The stunt kite of claim 12 wherein said partition is comprised of an elastomeric material.

14. The stunt kite of claim 8 wherein said leading edge rod is approximately equal in length to said wing rods, said keel rod is approximately one half the length of said leading edge rod, and said lower cross rod is approximately twice the length of said leading edge rod.

15. The stunt kite of claim 8 wherein said leading edge rod and said wing rods are about 77.50–87.50 cm, said keel rod is about 38.75–43.75 cm, said upper cross rod is about 136.00–156.00 cm, said lower cross rod is about 155.10–175.10 cm, said upper cross rod is about 26.25–36.25 cm from said leading edge rod and said lower cross rod is about 36.25–46.25 cm from said leading edge rod.

16. A stunt kite comprising:

a sail of flexible material having a trailing edge;

a keel rod;

a leading edge rod substantially perpendicular to said keel rod and connected to an end of said keel rod;

a pair of wing rods connected to opposite ends of said leading edge rod, said wing rods lateral to and on opposite sides of said keel rod and extending rearwardly from said leading edge rod;

upper and lower cross rods disposed transversely of said keel rod, said lower cross rod connected to said wing rods and said keel rod, each of said cross rods divided into segments, whereby said leading edge rod is approximately equal in length to said wing rods, said keel rod is approximately one half the length of said leading edge rod, and said lower cross rod is approximately twice the length of said leading edge rod;

an air baffle of flexible material disposed transversely of said keel rod and adjacent to said trailing edge of said sail, connected to said sail near each of said wing rods and near both sides of said keel rod and connected to said upper cross rod to form a passageway through which air flows; and a partition disposed between said sail and said air baffle, said partition forming air channels within said air baffles.

17. A stunt kite comprising:

a sail of flexible material;

a keel rod;

a leading edge rod substantially perpendicular to said keel rod and connected to an end of said keel rod;

a pair of wing rods connected to opposite ends of said leading edge rod, and positioned laterally to and on opposite sides of said keel rod and extending rearwardly from said leading edge rod; and upper and lower cross rods substantially perpendicular to said keel rod and disposed transversely of said keel rod, at least one of said cross rods connected to said wing rods and said keel rod wherein said leading edge rod is approximately equal in length to said wing rods, said keel rod is approximately one half the length of said leading edge rod, and said lower cross rod is approximately twice the length of said leading edge rod.

18. The stunt kite of claim 17 wherein said leading edge rod and said wing rods are about 77.50–87.50 cm, said keel rod is about 38.75–43.75 cm, said upper cross rod is about 136.00--156.00 cm, said lower cross rod is about 155.10–175.10 cm, said upper cross rod is about 26.25–36.25 cm from said leading edge rod and said lower cross rod is about 36.25–46.25 cm from said leading edge rod.

19. The stunt kite of claim 17 wherein said cross rods are divided into segments.

20. A stunt kite comprising:

a sail;

an air baffle comprising a sheet of flexible material disposed transversely of said kite and substantially parallel to said sail to form a passageway through which air flows; and an elastomeric partition disposed between said air baffle and said sail, said elastomeric partition forming air channels within said air baffle.

21. The stunt kite of claim 20 further comprising a trailing edge portion, said baffle disposed adjacent to the trailing edge portion.

22. The stunt kite of claim 20 further comprising a pair of wing rods and a keel rod, said baffle connected to said sail near each of said wing rods and near each side of said keel rod.

23. The stunt kite of claim 20 further comprising a plurality of said partitions forming a plurality of air channels.

24. The stunt kite of claim 20 wherein each of said air channels is about 20.00–30.00 cm in width.

25. A stunt kite comprising:

a sail of flexible material;

a keel rod;

a leading edge rod substantially perpendicular to said keel rod and connected to an end of said keel rod;

a pair of wing rods connected to opposite ends of said leading edge rod, and positioned laterally to and on opposite sides of said keel rod and extending rearwardly from said leading edge rod;

upper and lower cross rods disposed transversely of said keel rod, at least one of said cross rods connected to said wing rods and said keel rod;

an air baffle of flexible material disposed transversely of said keel rod to form a passageway through which air flows; and at least one partition disposed between said sail and said air baffle, said partition forming air channels within said air baffle.

26. The stunt kite of claim 25 wherein said cross rods are divided into segments.

27. The stunt kite of claim 25 wherein said kite has a trailing edge portion and said air baffle is disposed adjacent to said trailing edge portion.

28. The stunt kite of claim 25 wherein said air baffle is connected to said sail near each of said wing rods and near both sides of said keel rod.

29. The stunt kite of claim 25 wherein said partition is comprised of an elastomeric material.

30. The stunt kite of claim 25 wherein said leading edge rod is approximately equal in length to said wing rods, said keel rod is approximately one half the length of said leading edge rod, and said lower cross rod is approximately twice the length of said leading edge rod.

31. The stunt kite of claim 25 wherein said leading edge rod and said wing rods are about 77.50–87.50 cm, said keel rod is about 38.75–43.75 cm, said upper cross rod is about 136.00–156.00 cm, said lower cross rod is about 155.10–175.10 cm, said upper cross rod is about 26.25–36.25 cm from said leading edge rod and said lower cross rod is about 36.25–46.25 cm from said leading edge rod.

32. An assemblable stunt kite comprising:

a sail of flexible material;

a keel rod;

a leading edge rod substantially perpendicular to said keel rod and connected to an end of said keel rod;

a pair of wing rods connected to opposite ends of said leading edge rod, and positioned laterally to and on opposite sides of said keel rod and extending rearwardly from said leading edge rod;

upper and lower cross rods disposed transversely of said keel rod, at least one of said cross rods connected to said wing rods and said keel rod;

an air baffle of flexible material disposed transversely of said keel rod to form a passageway through which air flows, wherein said leading edge rod is approximately equal in length to said wing rods, said keel rod is approximately one half the length of said leading edge rod, and said lower cross rod is approximately twice the length of said leading edge rod.

33. The stunt kite of claim 32 wherein said cross rods are divided into segments.

34. The stunt kite of claim 32 wherein said kite has a trailing edge portion and said air baffle is disposed adjacent to said trailing edge portion.

35. The stunt kite of claim 32 wherein said air baffle is connected to said sail near each of said wing rods and near both sides of said keel rod.

36. The stunt kite of claim 32 wherein said leading edge rod and said wing rods are about 77.50–87.50 cm, said keel rod is about 38.75–43.75 cm, said upper cross rod is about 136.00–156.00 cm, said lower cross rod is about 155.10–175.10 cm, said upper cross rod is about 26.25–36.25 cm from said leading edge rod and said lower cross rod is about 36.25–46.25 cm from said leading edge rod.

* * * * *